US006881146B2

(12) United States Patent
Anderson et al.

(10) Patent No.: US 6,881,146 B2
(45) Date of Patent: Apr. 19, 2005

(54) GAMING MACHINE WITH PATTERN-DRIVEN BONUS ARRAY

(75) Inventors: Peter R. Anderson, Chicago, IL (US); John D. Flint, Chicago, IL (US); John J. Giobbi, Northbrook, IL (US); Shridhar P. Joshi, Skokie, IL (US); Erica A. Frohm, Evanston, IL (US)

(73) Assignee: WMS Gaming Inc., Waukegan, IL (US)

( * ) Notice: Subject to any disclaimer, the term of this patent is extended or adjusted under 35 U.S.C. 154(b) by 0 days.

(21) Appl. No.: 09/928,116

(22) Filed: Aug. 10, 2001

(65) Prior Publication Data

US 2002/0039918 A1 Apr. 4, 2002

Related U.S. Application Data

(60) Provisional application No. 60/225,936, filed on Aug. 17, 2000.

(51) Int. Cl.[7] ..... A63F 9/24

(52) U.S. Cl. ..... 463/16; 463/25

(58) Field of Search ..... 463/9, 16–20, 463/21; 273/237, 271, 138.1, 138.2, 139, 143 R, 269, 274, 460, 461

(56) References Cited

U.S. PATENT DOCUMENTS

| | | | | | |
|---|---|---|---|---|---|
| 4,275,442 | A | * | 6/1981 | Underwood et al. | 463/9 |
| 4,684,136 | A | * | 8/1987 | Turner | 273/271 |
| 5,393,057 | A | * | 2/1995 | Marnell, II | 463/13 |
| 5,743,796 | A | * | 4/1998 | Orak et al. | 463/9 |
| 5,927,714 | A | * | 7/1999 | Kaplan | 273/143 R |
| 6,213,873 | B1 | * | 4/2001 | Gasper et al. | 463/14 |
| 6,309,300 | B1 | * | 10/2001 | Glavich | 463/26 |
| 6,312,334 | B1 | * | 11/2001 | Yoseloff | 463/25 |
| 6,322,074 | B1 | * | 11/2001 | Forrest et al. | 273/272 |
| 6,334,814 | B1 | * | 1/2002 | Adams | 463/20 |
| 6,413,160 | B1 | * | 7/2002 | Vancura | 463/16 |
| 6,461,241 | B1 | * | 10/2002 | Webb et al. | 463/20 |

FOREIGN PATENT DOCUMENTS

| | | | | |
|---|---|---|---|---|
| GB | 2242300 A | | 9/1991 | G07F/17/34 |
| WO | WO98/09259 | | 3/1998 | G07F/17/34 |
| WO | WO 98/09259 | * | 5/1998 | G07F/17/34 |
| WO | WO00/17831 | | 3/2000 | G07F/17/34 |

OTHER PUBLICATIONS

The Hollywood Squares (1975: King World Productions); Alliaume, Curt, Jul. 29, 2002, http://www.curtalliaume.com/squares.html, pp. 1 and 2.*

Secret X; Greco, Kathy, circa 1978, http://gscentral.net/secretx.htm, p. 1.*

Branding: Anderson Associates, date unknown, http://www.aa–advertising.com/brandingone.html, p. 1.*

* cited by examiner

*Primary Examiner*—Michael O'Neill
(74) *Attorney, Agent, or Firm*—Jenkens & Gilchrist

(57) ABSTRACT

A game of chance is played on a gaming machine controlled by a processor in response to a wager. The game includes an array of locations displayed on a video display and individually selectable by a player and the processor. The player and the processor make alternating selections of unoccupied ones of the locations in the array for placement of respective first and second symbol types. The probability of using a winning strategy for the selections by the processor increases with successive ones of the selections by the processor so that the processor appears to become more intelligent as the game progresses. A payout is awarded to the player based on an outcome of the game.

10 Claims, 16 Drawing Sheets

GAMING MACHINE WITH PATTERN-DRIVEN BONUS ARRAY

CROSS-REFERENCE TO RELATED APPLICATION

This application claims the benefit of priority of Provisional Patent Application Ser. No. 60/225,936 filed Aug. 17, 2000.

FIELD OF THE INVENTION

The present invention relates generally to gaming machines and, more particularly, to a gaming machine including a pattern-driven bonus array.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines. Shrewd operators consequently strive to employ the most entertaining and exciting machines available because such machines attract frequent play and hence increase profitability to the operator. Accordingly, in the competitive gaming machine industry, there is a continuing need for gaming machine manufacturers to produce new types of games, or enhancements to existing games, which will attract frequent play by enhancing the entertainment value and excitement associated with the game.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome of the basic game. Because the bonus game concept offers tremendous advantages in player appeal and excitement relative to other known games, and because such games are attractive to both players and operators, there is a continuing need to develop new features for bonus games to satisfy the demands of players and operators. Preferably, such new bonus game features will maintain, or even further enhance, the level of player excitement offered by bonus games heretofore known in the art. The present invention is directed to satisfying these needs.

SUMMARY OF THE INVENTION

In accordance with one aspect of the present invention, a game of chance is played on a gaming machine controlled by a processor in response to a wager. The game includes an array of locations displayed on a video display and individually selectable by a player and the processor. The player and the processor make alternating selections of unoccupied ones of the locations in the array for placement of respective first and second symbol types. The probability of using a winning strategy for the selections by the processor increases with successive ones of the selections by the processor so that the processor appears to become more intelligent as the game progresses. A payout is awarded to the player based on an outcome of the game.

In accordance with another aspect of the present invention, a game of chance is played on a gaming machine controlled by a processor in response to a wager. The game includes an array of locations displayed on a video display and individually selectable by a player. The player makes a selection of one of the locations in the array. One of a predetermined number of possible symbol types is displayed at the selected location based on a randomly-selected answer to a trivia question. A payout is awarded in response to the displayed symbol types forming a winning pattern.

In accordance with a further aspect of the present invention, a game of chance is played on a gaming machine controlled by a processor in response to a wager. The game includes an array of locations displayed on a video display and individually selectable by a player. At least one of the locations is associated with a hidden symbol of a first symbol type. The player makes one or more selections of one or more of the locations in the array for placement of symbols of the first symbol type. The hidden symbol is then revealed. A payout is awarded in response to the placed symbols and the hidden symbol forming a winning pattern.

BRIEF DESCRIPTION OF THE DRAWINGS

The foregoing and other advantages of the invention will become apparent upon reading the following detailed description and upon reference to the drawings in which.

Figure 1:
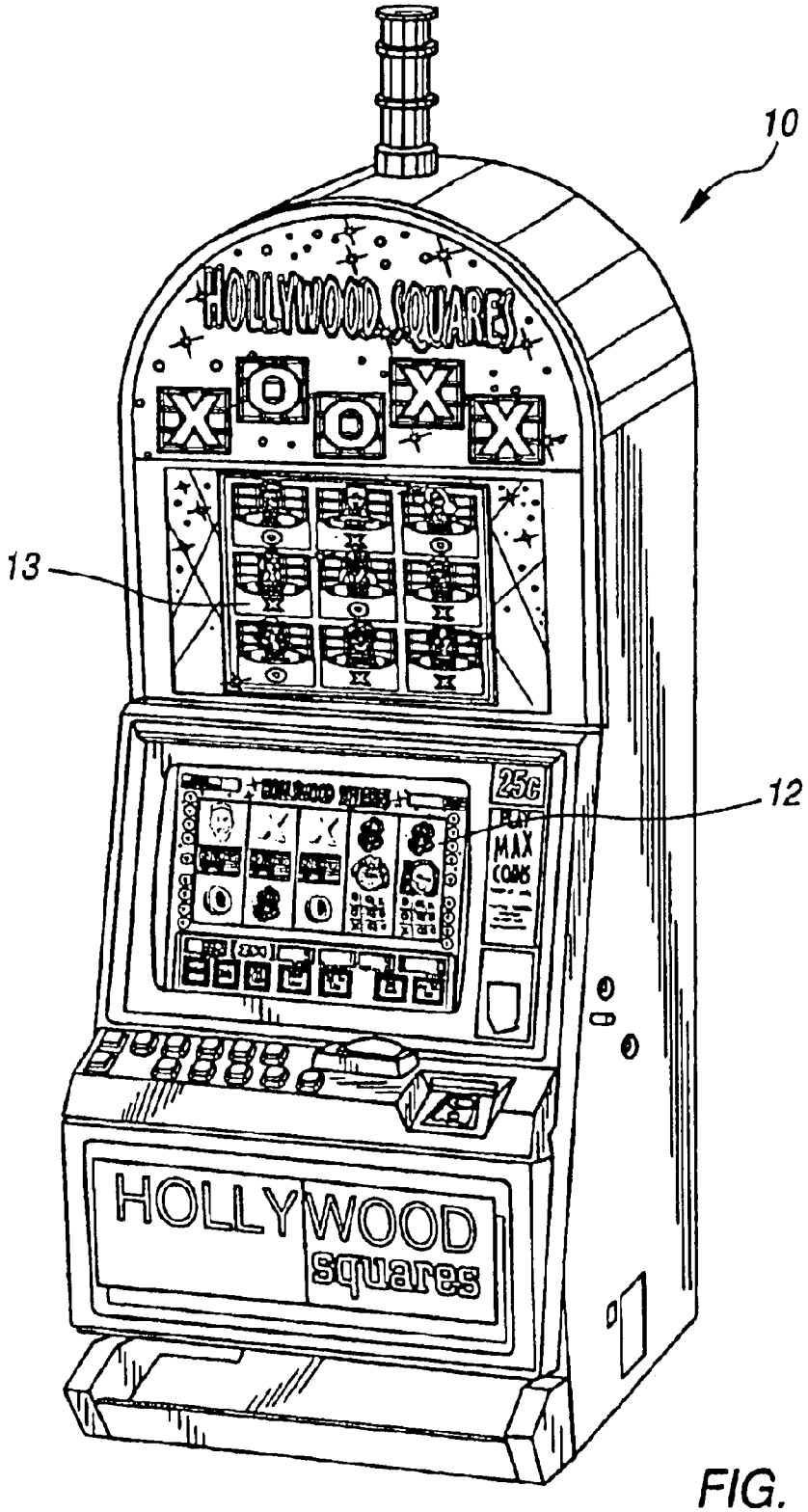
FIG. 1 is a perspective view of a gaming machine embodying the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF SPECIFIC EMBODIMENTS

Turning now to the drawings and referring initially to FIG. 1, there is depicted a gaming machine 10 that may be used to implement a bonus game according to the present invention. The gaming machine 10 includes lower and upper visual displays 12 and 13 preferably in the form of a dot matrix, CRT, LED, LCD, electro-luminescent, or other type of video display known in the art. The lower display 12 preferably includes a touch screen overlaying the monitor. In the illustrated embodiment, the gaming machine 10 is an "upright" version in which the visual displays 12 and 13 are both oriented vertically relative to the player. Alternatively, the gaming machine may be a "slant-top" version in which the lower display 12 is slanted at about a thirty-degree angle toward the player and the upper display 13 is oriented vertically relative to the player.

In one embodiment, the gaming machine 10 is operable to play a game of chance entitled HOLLYWOOD SQUARES™ having a theme consistent with the popular HOLLYWOOD SQUARES™ game show. The HOLLYWOOD SQUARES game features a basic slot game with five simulated spinning reels, a HOLLYWOOD SQUARES bonus game with a 3×3 tic-tac-toe array, and a SUPER STAR bonus game played on the reels. It will be appreciated, however, that the gaming machine 10 may be implemented with games other than HOLLYWOOD SQUARES and/or with any of several alternative game themes.

Figure 2:
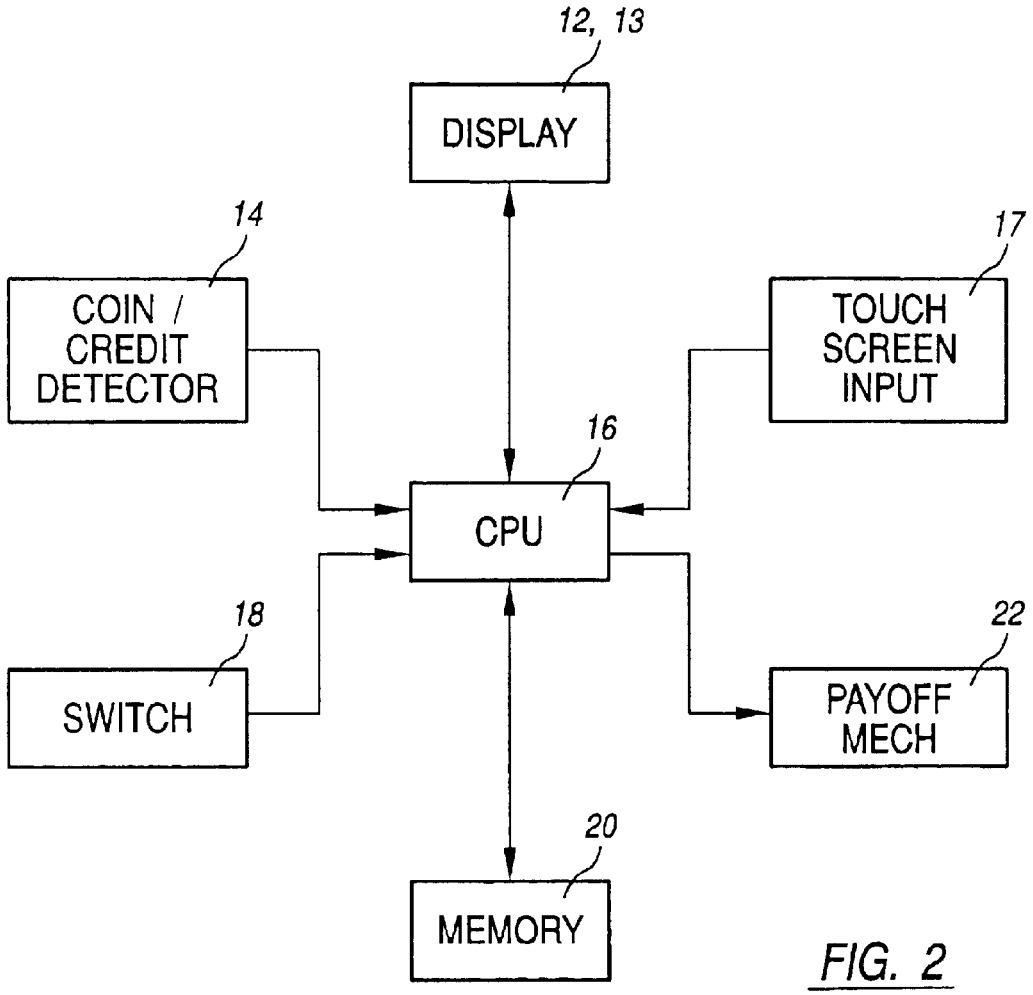
FIG. 2 is a block diagram of a control system suitable for operating the gaming machine.

FIG. 2 is a block diagram of a control system suitable for operating the gaming machine 10. Coin/credit detector 14 signals a central processing unit (CPU) 16 when a player has inserted a number of coins or played a number of credits. Then, the CPU 16 operates to execute a game program that causes the video display 12 to display the basic game that includes simulated symbol-bearing reels. The player may select the number of pay lines to play and the amount to wager via touch screen input keys 17. The basic game commences in response to the player activating a switch 18 (e.g., by pulling a lever or pushing a button), causing the CPU 16 to set the reels in motion, randomly select a game outcome and then stop the reels to display symbols corresponding to the pre-selected game outcome. In one embodiment, certain of the basic game outcomes cause the CPU 16 to enter a bonus mode.

A system memory 20 stores control software, operational instructions and data associated with the gaming machine 10. In one embodiment, the memory 20 comprises a separate read-only memory (ROM) and battery-backed random-access memory (RAM). However, it will be appreciated that the system memory 20 may be implemented on any of several alternative types of memory structures or may be implemented on a single memory structure. A payoff mechanism 22 is operable in response to instructions from the CPU 16 to award a payoff of coins or credits to the player in response to certain winning outcomes which might occur in the basic game or bonus games. The payoff amounts corresponding to certain combinations of symbols in the basic game is predetermined according to a pay table stored in system memory 20. The payoff amounts corresponding to certain outcomes in the bonus games are also stored in system memory 20.

Figure 3:
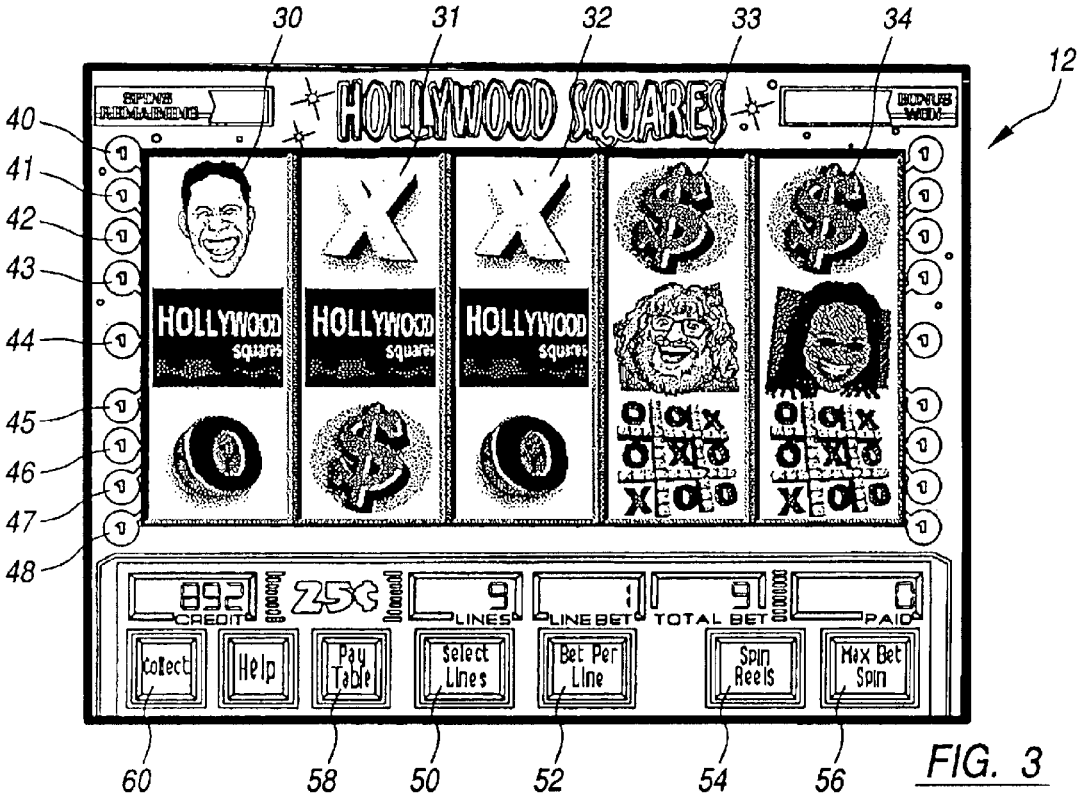
FIG. 3 is a display screen capture showing a first start-bonus outcome including three HOLLYWOOD SQUARES™ symbols on respective reels of a five-reel, nine-line basic game played on the gaming machine.

As shown in FIG. 3, the HOLLYWOOD SQUARES basic game is implemented on the video display 12 on five video simulated spinning reels 30, 31, 32, 33 and 34 (hereinafter "reels") with nine pay lines 40–48. Each of the pay lines 40–48 extends through one symbol on each of the five reels 30–34. Generally, game play is initiated by inserting a number of coins or playing a number of credits, causing the CPU 16 (FIG. 2) to activate a number of pay lines corresponding to the number of coins or credits played. In one embodiment, the player selects the number of pay lines (between one and nine) to play by pressing a "Select Lines" key 50 on the video display 12. The player then chooses the number of coins or credits to bet on the selected pay lines by pressing the "Bet Per Line" key 52.

After activation of the pay lines, the reels 30–34 may be set in motion by touching the "Spin Reels" key 54 or, if the player wishes to bet the maximum amount per line, by using the "Max Bet Spin" key 56 on the video display 12. Alternatively, other mechanisms such as, for example, a lever or push button may be used to set the reels in motion. The CPU 16 uses a random number generator to select a game outcome (e.g., "basic" game outcome) corresponding to a particular set of reel "stop positions." The CPU 16 then causes each of the video reels 30–34 to stop at the appropriate stop position. Video symbols are displayed on the reels 30–34 to graphically illustrate the reel stop positions and indicate whether the stop positions of the reels represent a winning game outcome.

Winning basic game outcomes (e.g., symbol combinations resulting in payment of coins or credits) are identifiable to the player by a pay table. In one embodiment, the pay table is affixed to the machine 10 and/or displayed by the video display 12 in response to a command by the player (e.g., by pressing the "Pay Table" button 58). A winning basic game outcome occurs when the symbols appearing on the reels 30–34 along an active pay line correspond to one of the winning combinations on the pay table. A winning combination, for example, could be three or more matching symbols along an active pay line, where the award is greater as the number of matching symbols along the active pay line increases. If the displayed symbols stop in a winning combination, the game credits the player an amount corresponding to the award in the pay table for that combination multiplied by the amount of credits bet on the winning pay line. The player may collect the amount of accumulated credits by pressing the "Collect" button 60. The game optionally employs a "wild" STAR symbol that can serve as another symbol to create a winning combination. In a preferred implementation, the winning combinations start from the first reel 30 (left to right) and span adjacent reels. In an alternative implementation, the winning combinations start from either the first reel 30 (left to right) or the fifth reel 34 (right to left) and span adjacent reels.

Included among the plurality of basic game outcomes are one or more start-bonus outcomes for triggering play of a bonus game associated with the start-bonus outcome. A start-bonus outcome may be defined in any number of ways. For example, a start-bonus outcome occurs when a special start-bonus symbol or a special combination of symbols (e.g., three HOLLYWOOD SQUARES symbols) appears on one or more of the reels 30–34. The start-bonus outcome may require the combination of symbols to appear along an active pay line, or may alternatively require that the combination of symbols appear anywhere on the display regardless of whether the symbols are along an active pay line. The appearance of a start-bonus outcome causes the processor to shift operation from the basic game to the bonus game associated with that start-bonus outcome.

Figure 4:
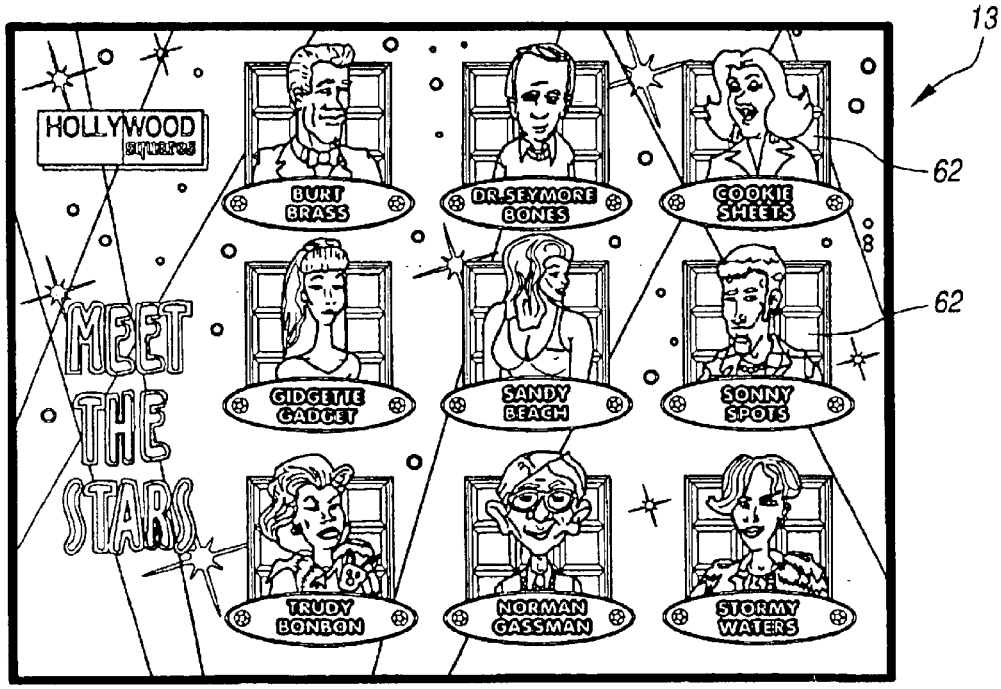
FIGS. 4, 5, 6, 7, and 8 are display screen captures showing a first embodiment of a HOLLYWOOD SQUARES bonus game triggered by the first start-bonus outcome in FIG. 3.

A HOLLYWOOD SQUARES bonus game is triggered by three HOLLYWOOD SQUARES symbols along an active pay line in the basic slot game. A first embodiment of the HOLLYWOOD SQUARES bonus game employs both the lower and upper displays 12 and 13. Initially, as shown in FIG. 4, the upper display 13 depicts a tic-tac-toe array of locations (squares) 62 individually selectable by a player. An animated celebrity is illustrated in each location 62. The illustrated celebrities starting from the upper left location in the array are Burt Brass, Dr. Seymore Bones, Cookie Sheets, Gidgette Gadget, Sandy Beach, Sonny Spots, Trudy Bonbon, Norman Gassman, and Stormy Waters.

Figure 5:
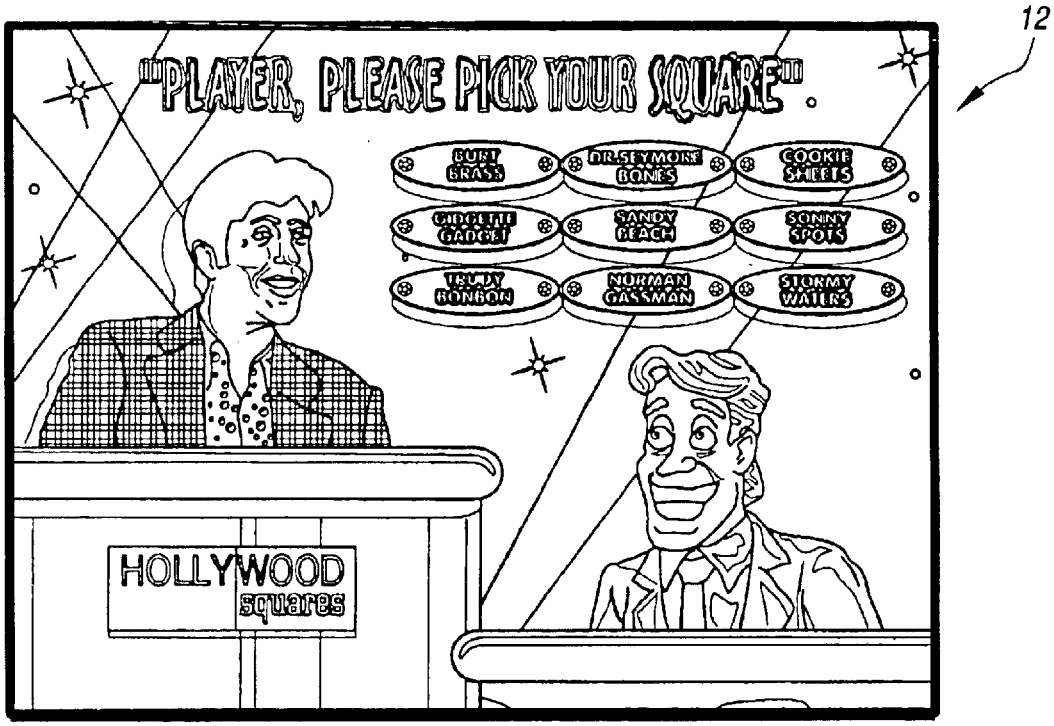

At the same time, as shown in FIG. 5 the lower display 12 asks the player to pick a location (square) of the array on the upper display 13. To select one of the locations 62 on the upper display 13 (see FIG. 4), the player touches the touch screen lower display 12 above the name of any one of the celebrities that does not already have a symbol type (e.g., "X" or "O") associated therewith from a prior round of the bonus game. The HOLLYWOOD SQUARES game show essentially involved the combination of tic-tac-toe and trivia questions. Consistent with the game show, the bonus game allows one of two symbol types to be associated with each location. These two symbol types are an "X" and an "O". In the illustrated array, none of the locations 62 has a symbol type associated therewith and, therefore, the player can select any of the celebrities. In the example, the player selects Norman Gassman.

Prior to assigning one of the symbol types (e.g., "X" or "O") to the selected location in the array, the CPU executes the trivia question portion of the HOLLYWOOD SQUARES bonus game and depicts a trivia question on the lower display 12 to be answered by the selected celebrity. The trivia question is randomly selected from a set of questions stored in game memory. In the HOLLYWOOD SQUARES game show, the selected celebrity was asked a trivia question, and the celebrity (after a long explanation) provided an answer to the trivia question. The contestant was then asked whether the contestant agreed or disagreed with the celebrity's answer. If the contestant agreed with the celebrity's answer and the celebrity's answer was correct, or if the contestant disagreed with the celebrity's answer and the celebrity's answer was incorrect, then the contestant's assigned symbol (e.g., "X") was placed at the celebrity's location in the tic-tac-toe array. If, however, the contestant agreed with the celebrity's answer and the celebrity's answer was incorrect, or if the contestant disagreed with the celebrity's answer and the celebrity's answer was correct, then the opposing contestant's assigned symbol (e.g., "O") was placed at the celebrity's location in the tic-tac-toe array. The first contestant to get tic-tac-toe, i.e., three of the same symbol along a row, a column, or a diagonal, won the game. In the event of a stalemate/draw ("cat's" game), additional trivia questions were provided.

Because the gaming machine operates primarily as a game of chance, not skill, the player of the gaming machine is not given an opportunity to select whether the player agrees or disagrees with the selected celebrity's answer after the answer is depicted on the lower display 12. Rather, either the CPU randomly determines whether the player agrees or disagrees with the answer without player involvement, or prompts the player to make a selection indicating agreement or disagreement with the celebrity prior to depicting the celebrity's answer on the lower display 12.

Figure 6:
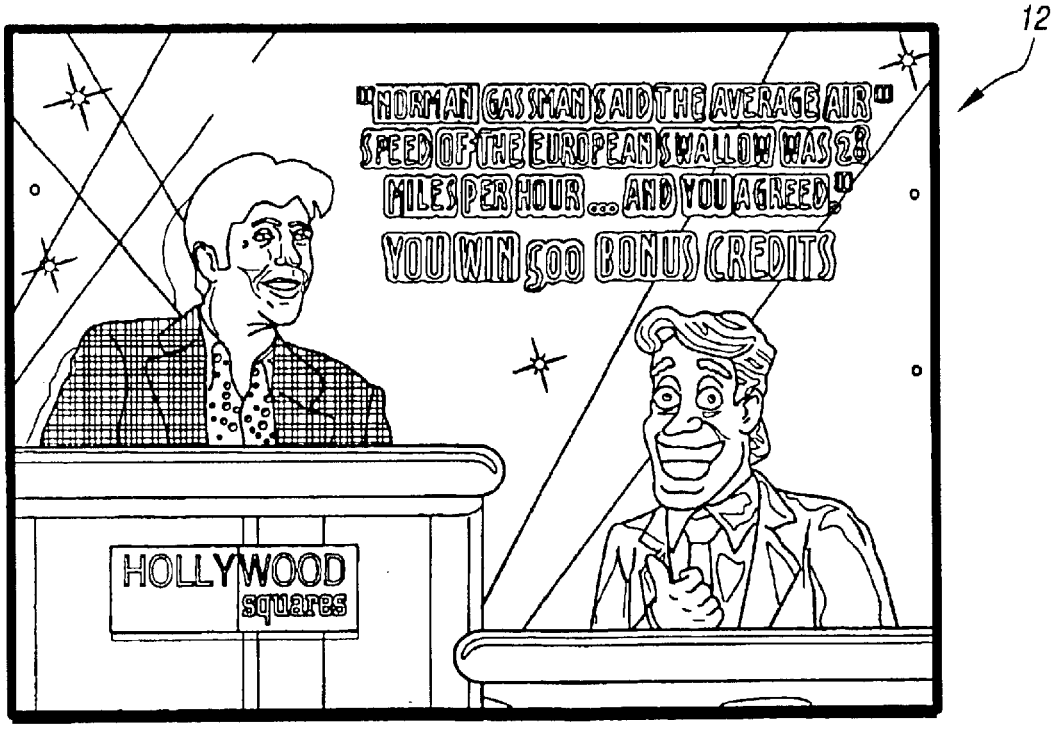
Figure 7:
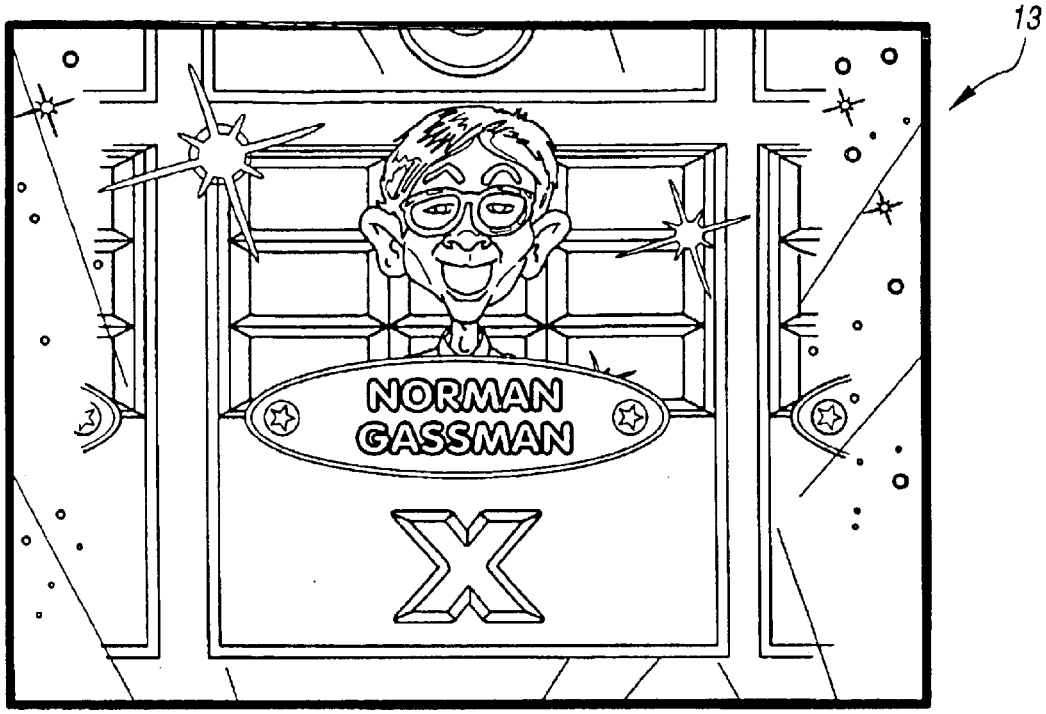
Figure 8:
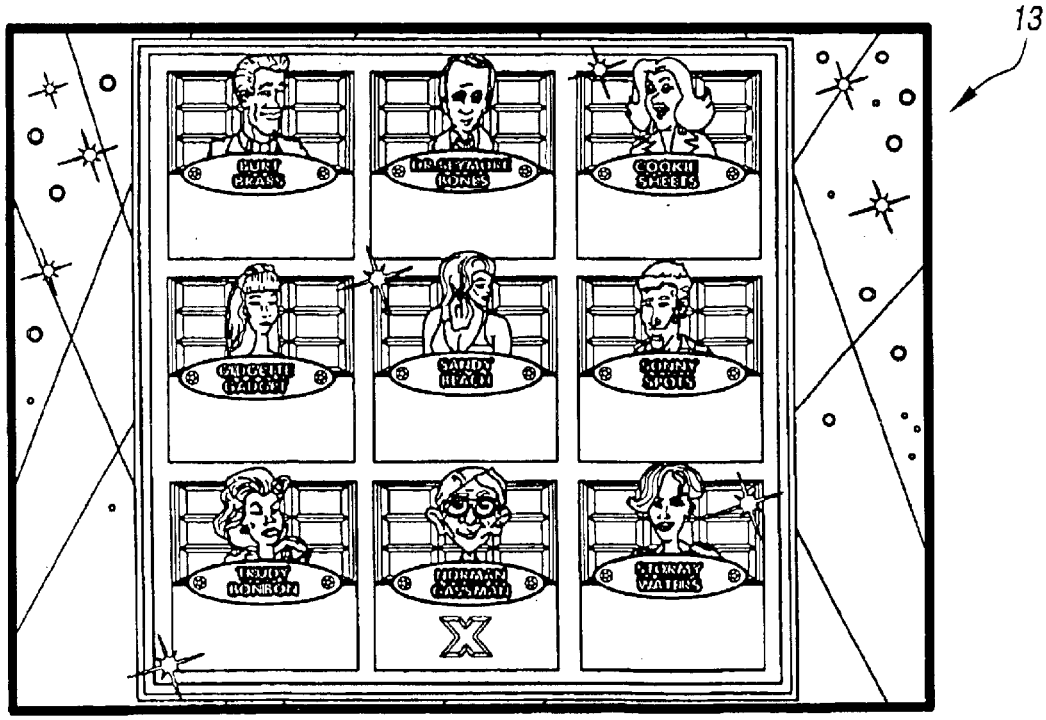

If the CPU or player agrees with the selected celebrity's answer and the celebrity's answer is correct, or if the CPU or player disagrees with the celebrity's answer and the celebrity's answer is incorrect, then (1) the player may be awarded a bonus as shown by the lower display screen capture in FIG. 6 and (2) the player's assigned symbol (e.g., "X") is placed at the celebrity's location in the tic-tac-toe array as shown by the upper display screen captures in FIGS. 7 and 8. The upper display 13 first depicts an enlarged view of the celebrity's location marked with an "X" (FIG. 7), and then depicts the entire bonus array with the selected celebrity's location marked with an "X" (FIG. 8). The bonus may be in the form of a number of credits (see FIG. 6), a credit multiplier, and/or extended play. In the illustrated example, the player agreed with Norman Gassman's answer to the trivia question and Norman Gassman's answer was correct. Therefore, Norman Gassman's location in the bonus array is marked with the player's assigned symbol "X".

If, however, the CPU or player agrees with the selected celebrity's answer and the celebrity's answer is incorrect, or if the CPU or player disagrees with the celebrity's answer and the celebrity's answer is correct, then (1) the player is awarded either no bonus at all or a small bonus for having reached the bonus round and (2) the CPU's assigned symbol (e.g., "O") is placed at the celebrity's location in the tic-tac-toe array.

Depending upon the hit frequency of the bonus round, the bonus round may end or continue following a player's selection of a single celebrity and placement of a single symbol ("X" or "O") at the selected celebrity's location. For example, if the hit frequency is high such that the basic game triggers the bonus round every few spins, then the bonus round may end following a single celebrity selection and symbol placement. Alternatively, the bonus round may continue following a single placement of the player's symbol (e.g., "X") but end following a single placement of the CPU's symbol (e.g., "O"). If, however, the hit frequency is low such that the basic game rarely triggers the bonus round, then the bonus round may continue for several celebrity selections and respective symbol placements (by the player and/or the CPU), or until either the player or the CPU gets tic-tac-toe, i.e., three of the same symbol along a row, a column, or a diagonal. The player may be awarded an extra bonus for achieving a tic-tac-toe with the player's assigned symbol (e.g., "X"), but either no extra bonus or a smaller bonus for achieving a tic-tac-toe with the CPU's assigned symbol (e.g., "O"). The length of the bonus round may also be influenced by the start-bonus outcome that triggered the bonus round. After completion of the bonus round, the processor shifts operation back to the basic game. Also, the bonus array may be reset to include no "X's" or "O's", or may maintain its current state such that any placed "X's" and "O's" are carried over to succeeding bonus rounds.

Figure 9:
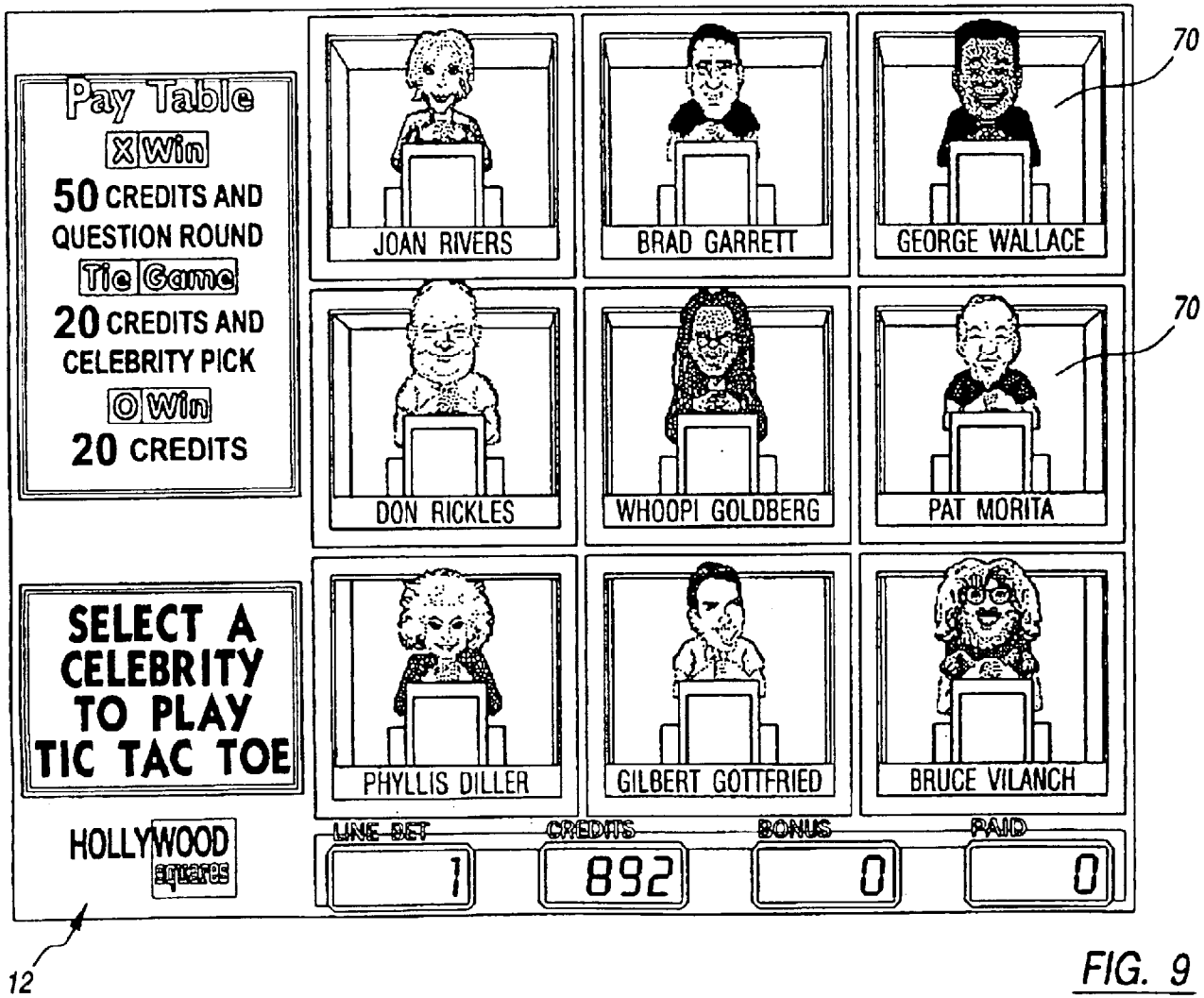
FIGS. 9, 10, 11, 12, 13, 14, 15, and 16 are display screen captures showing a second embodiment of a HOLLYWOOD SQUARES bonus game triggered by the first start-bonus outcome in FIG. 3.

A second embodiment of the HOLLYWOOD SQUARES bonus game employs only the lower display 12 and renders the upper display 13 optional. Initially, as shown in FIG. 9, the lower display 12 depicts a tic-tac-toe array of locations (squares) 70 individually selectable by a player. An animated celebrity is illustrated in each location 70. The player is prompted to play a tic-tac-toe game against CPU, where the player is assigned "X's" and the CPU is assigned "O's". The player may always select a location first, or whether the player or the CPU selects first may be randomly determined. The player and the CPU alternately select locations 70 to place their respective "X's" and "O's" until either the player wins with three "X's" along a row, a column, or a diagonal; the CPU wins with three "O's" along a row, a column, or a diagonal; or there is a stalemate/draw. In one embodiment, the player is awarded a modest payout for each "X" placed in the tic-tac-toe array.

During play of the tic-tac-toe game against the CPU, the CPU selects locations 70 for placement of "O's" based on a unique strategy. This strategy is based on the following math table:

| Selection | Choose Best Location |
|---|---|
| 1 | 70% |
| 2 | 80% |
| 3 | 90% |
| 4 | 95% |

It can be seen from the table that the CPU will, on average, become more intelligent with each successive selection made by the CPU. Alternatively, the table may be modified to vary the percentages from those shown. For example, the percentages could decrease with successive selections such that the CPU will, on average, become less intelligent with each successive selection made by the CPU. Also, the percentages could first increase and then decrease with successive selections.

Using the illustrated math table, after the player places his or her first "X", the CPU will select a best location for placement of its first "O" 70 percent of the time and will select a worst location for placement of its first "O" 30 percent of the time. If the CPU selects the best location and there are multiple best locations, the CPU will randomly select one of the best locations. Similarly, if the CPU selects the worst location and there are multiple worst locations, the CPU will randomly select on of the worst locations. For example, the player may place his or her first "X" in the center:

| | | |
|---|---|---|
| | | |
| | X | |
| | | |

In response to the player's placement of his or her first "X" in the center, the best locations "B" for the CPU to place its first "O" are the four corners and the worst locations "W" for the CPU to place its first "O" are the four non-corners:

| | | |
|---|---|---|
| B | W | B |
| W | X | W |
| B | W | B |

If the CPU selects a best location for placement of its first "O", which it will do 70 percent of the time, the CPU randomly selects one of the four corners. If, however, the CPU selects a worst location for placement of its first "O", which it will do 30 percent of the time, the CPU randomly selects one of the four non-corners. The two scenarios may be played by the CPU as follows:

| | | |
|---|---|---|
| | O | |
| | X | |
| | | |

Worst Location

| | | |
|---|---|---|
| O | | |
| | X | |
| | | |

Best Location

After the player places his or her second "X", the CPU will select a best location for placement of its second "O" 80 percent of the time and will select a worst location for placement of its second "O" 20 percent of the time. If the CPU selects the best location and there are multiple best locations, the CPU will randomly select one of the best locations. Similarly, if the CPU selects the worst location and there are multiple worst locations, the CPU will randomly select on of the worst locations. For example, in the following tic-tac-toe array, the player may place his or her second "X" in a corner:

| | | |
|---|---|---|
| | O | X |
| | X | |
| | | |

In response to the player's placement of his or her second "X" in the upper right corner, the best location "B" for the CPU to place its second "O" is the lower left corner to block a win by the player and the worst locations "W" for the CPU to place its second "O" are the remaining locations:

| | | |
|---|---|---|
| W | O | X |
| W | X | W |
| B | W | W |

If the CPU selects a best location for placement of its second "O", which it will do 80 percent of the time, the CPU selects the lower left corner. Such a selection will make it appear as though the CPU became more intelligent following a bad first selection. If, however, the CPU selects a worst location for placement of its second "O", which it will do 20 percent of the time, the CPU randomly selects one of the remaining locations. The two scenarios may be played by the CPU as follows:

| | | |
|---|---|---|
| O | O | X |
| | X | |
| | | |

Worst Location

| | | |
|---|---|---|
| | O | X |
| | X | |
| O | | |

Best Location

After the player places his or her third "X", the CPU will select a best location for placement of its third "O" 90 percent of the time and will select a worst location for placement of its third "O" 10 percent of the time. If the CPU selects the best location and there are multiple best locations, the CPU will randomly select one of the best locations. Similarly, if the CPU selects the worst location and there are multiple worst locations, the CPU will randomly select on of the worst locations. For example, in the following tic-tac-toe array, the player may place his or her third "X" in the lower right corner:

| | | |
|---|---|---|
| | O | X |
| | X | |
| O | | X |

In response to the player's placement of his or her third "X" in the lower right corner, the best locations "B" for the CPU to place its third "O" are the upper left corner or the right non-corner to block wins by the player and the worst locations "W" for the CPU to place its third "O" are the remaining locations:

| | | |
|---|---|---|
| B | O | X |
| W | X | B |
| O | W | X |

If the CPU selects a best location for placement of its third "O", which it will do 90 percent of the time, the CPU randomly selects either the upper left corner or the right non-corner. If, however, the CPU selects a worst location for placement of its third "O", which it will do 10 percent of the time, the CPU randomly selects one of the two remaining locations. The two scenarios may be played by the CPU as follows:

| | | |
|---|---|---|
| | O | X |
| O | X | |
| O | | X |

Worst Location

| | | |
|---|---|---|
| O | O | X |
| | X | |
| O | | X |

Best Location

In either scenario, the player should recognize that he or she can win the game with three aligned "X's" as follows:

| | | |
|---|---|---|
| O | O | X |
| | X | X |
| O | | X |

Figure 10:
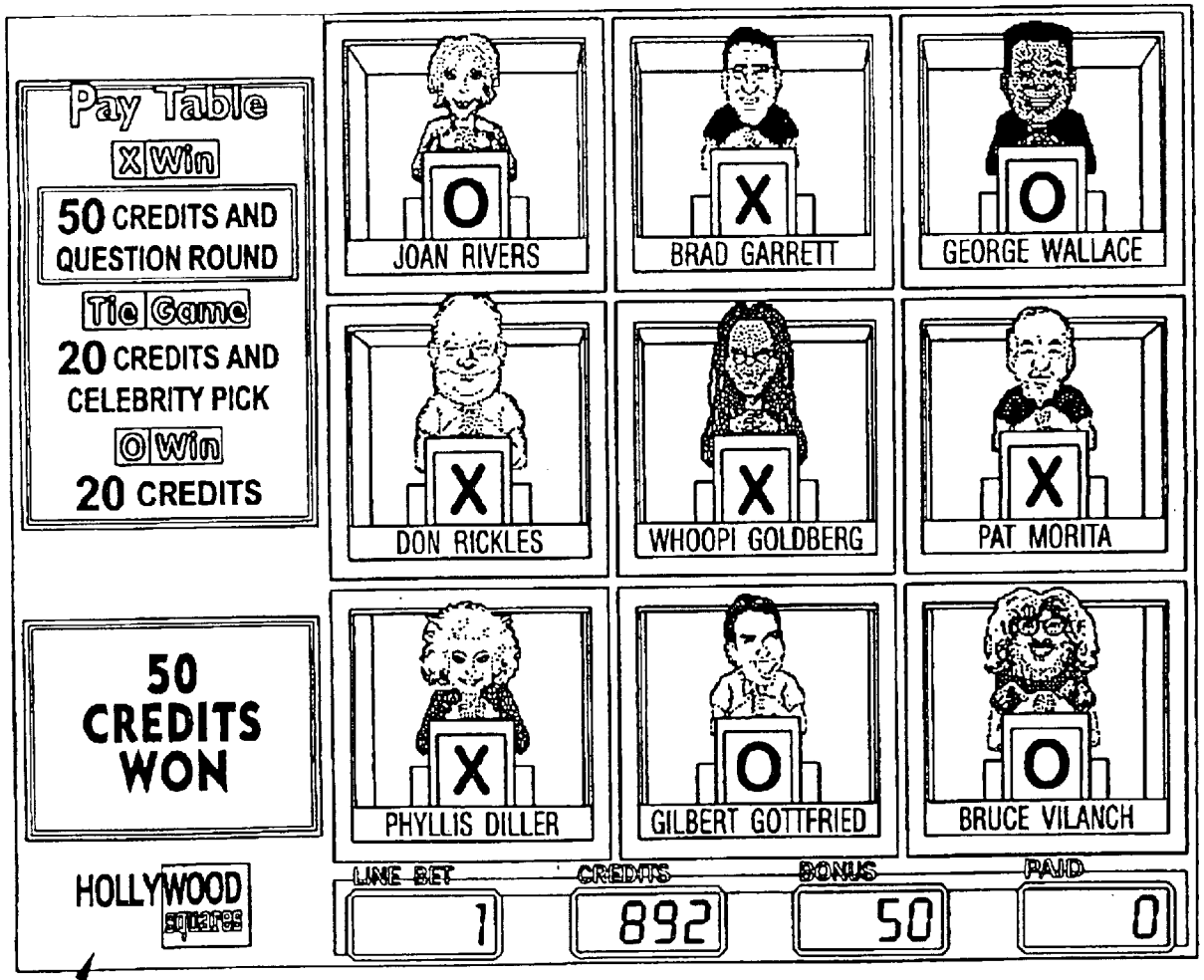
Figure 11:
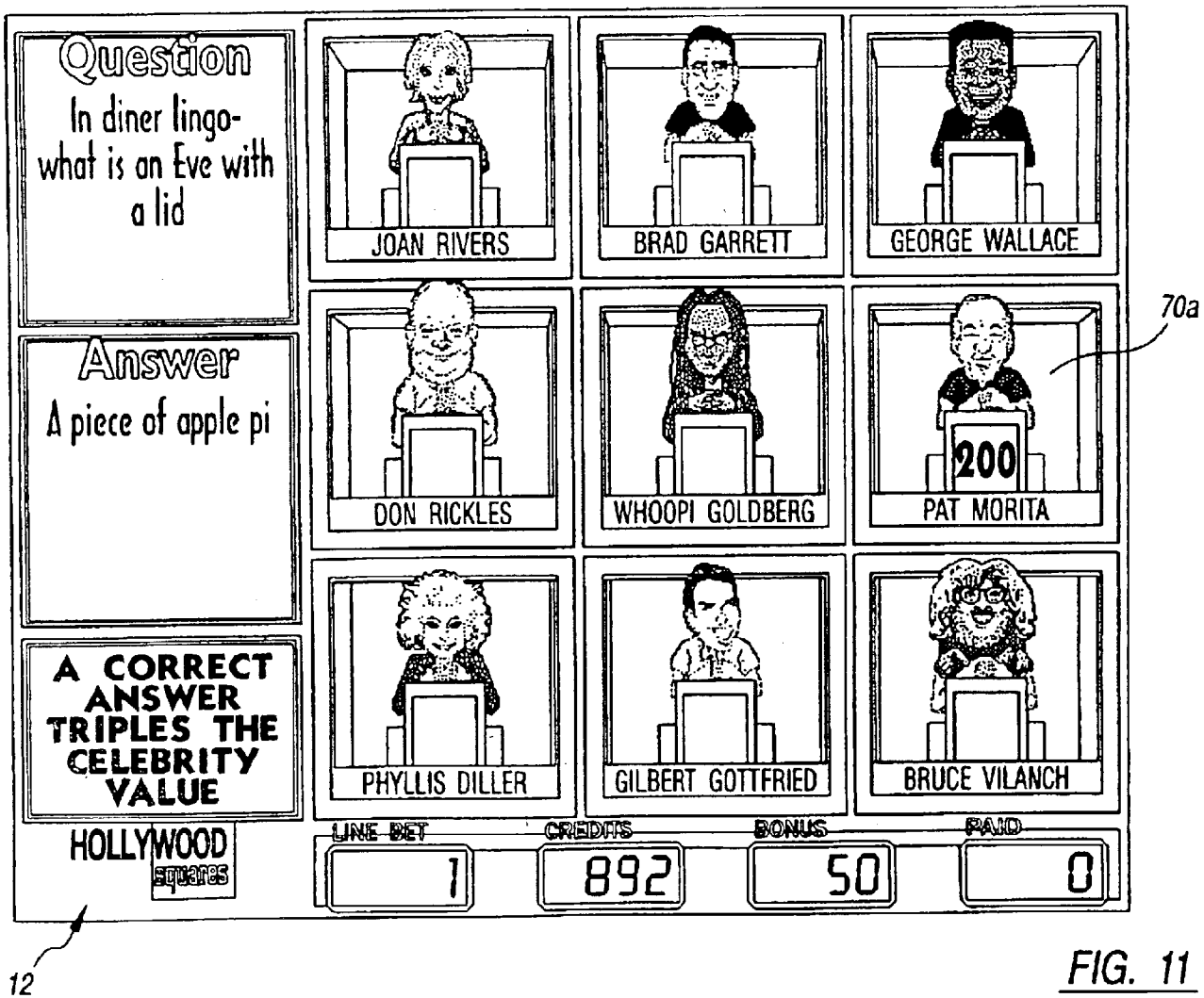
Figure 12:
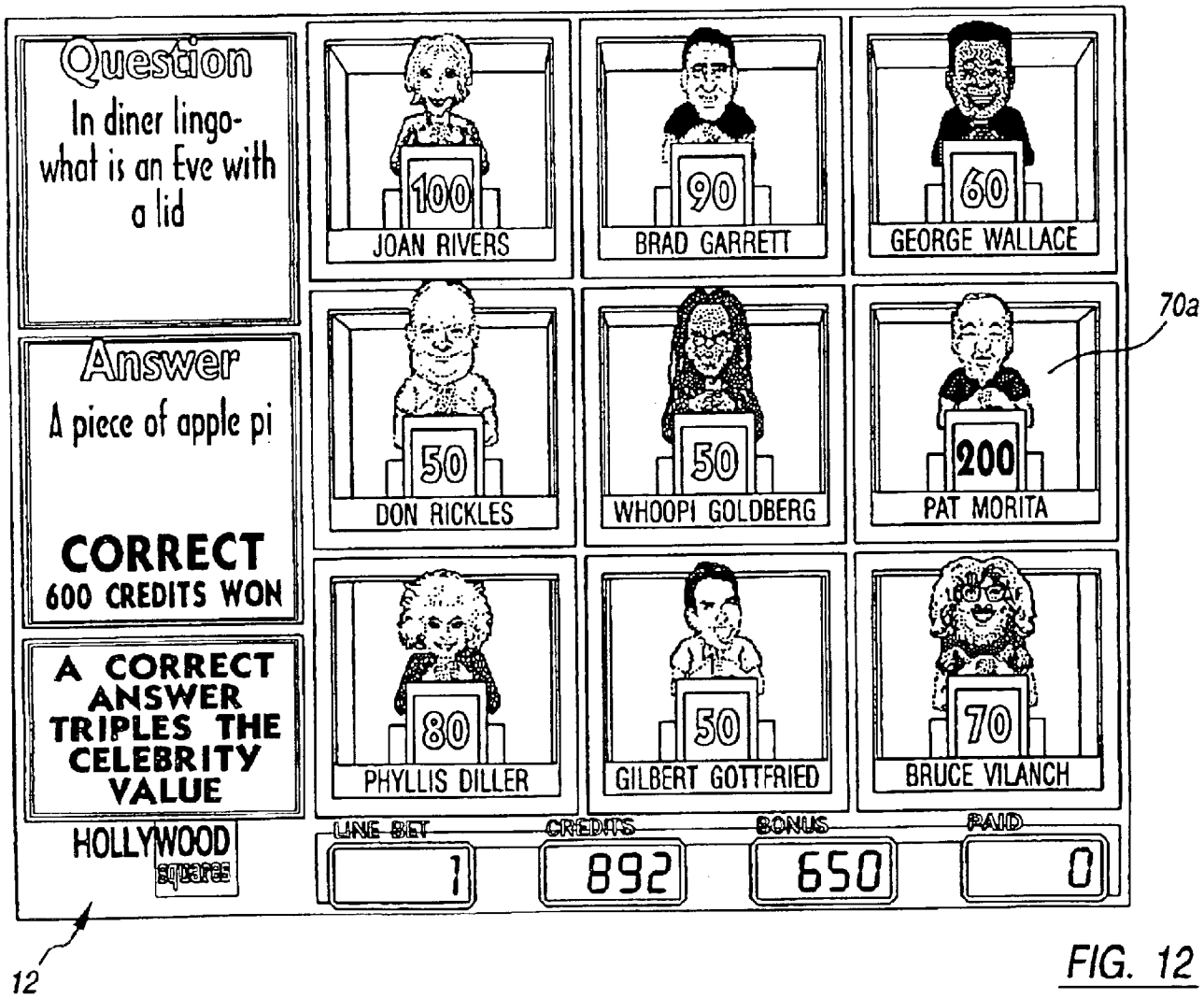
Figure 13:
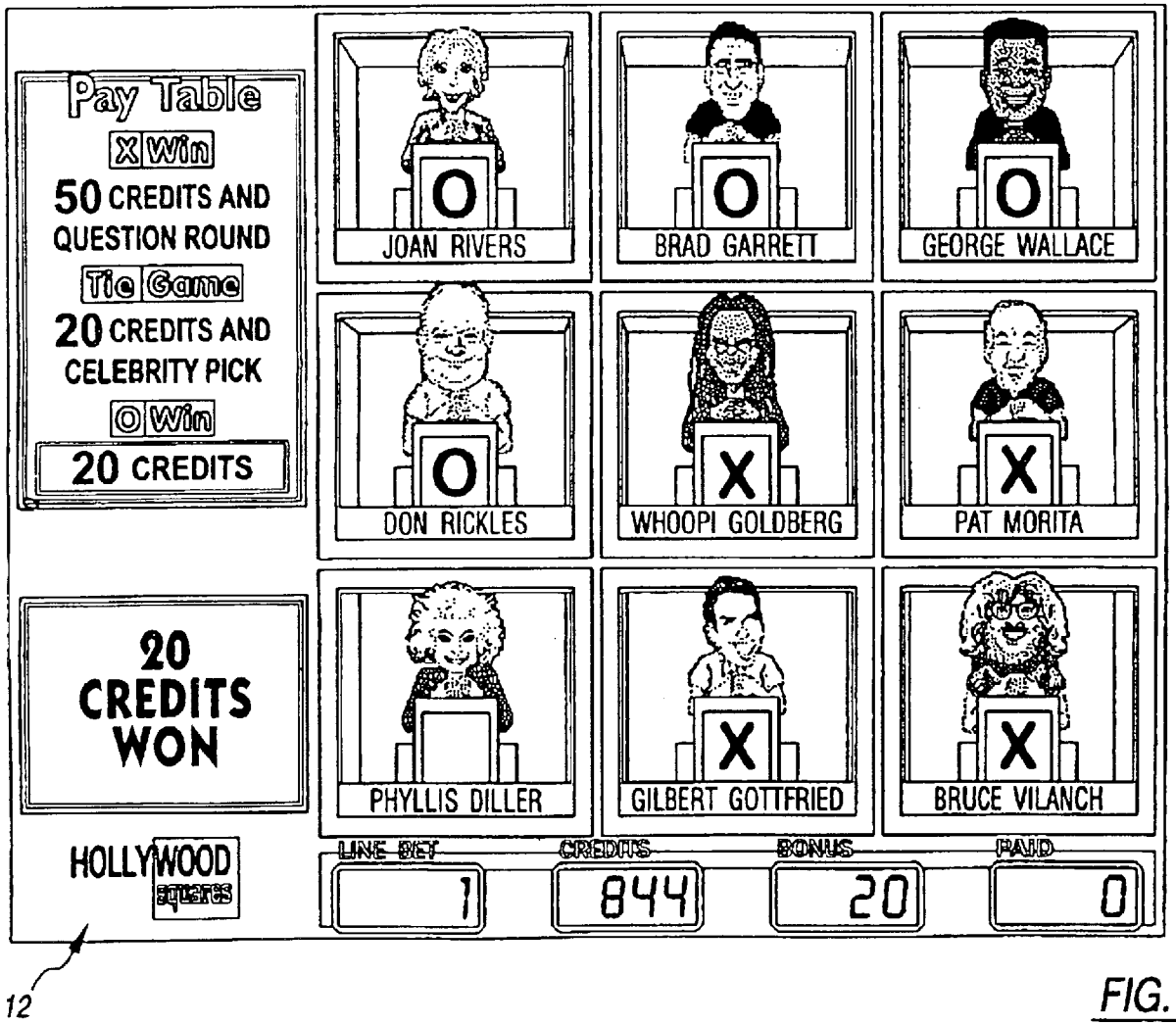
Figure 14:
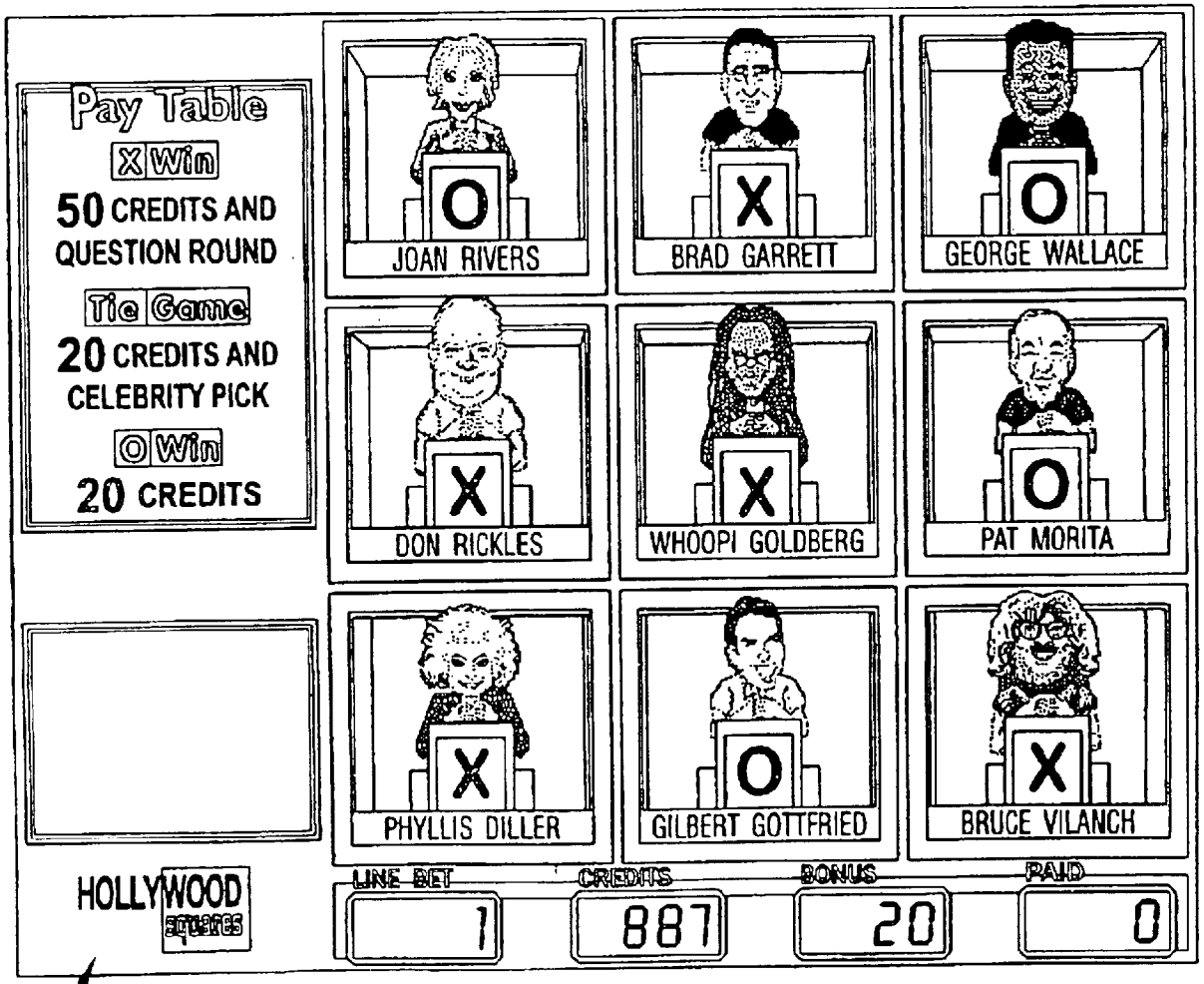
Figure 15:
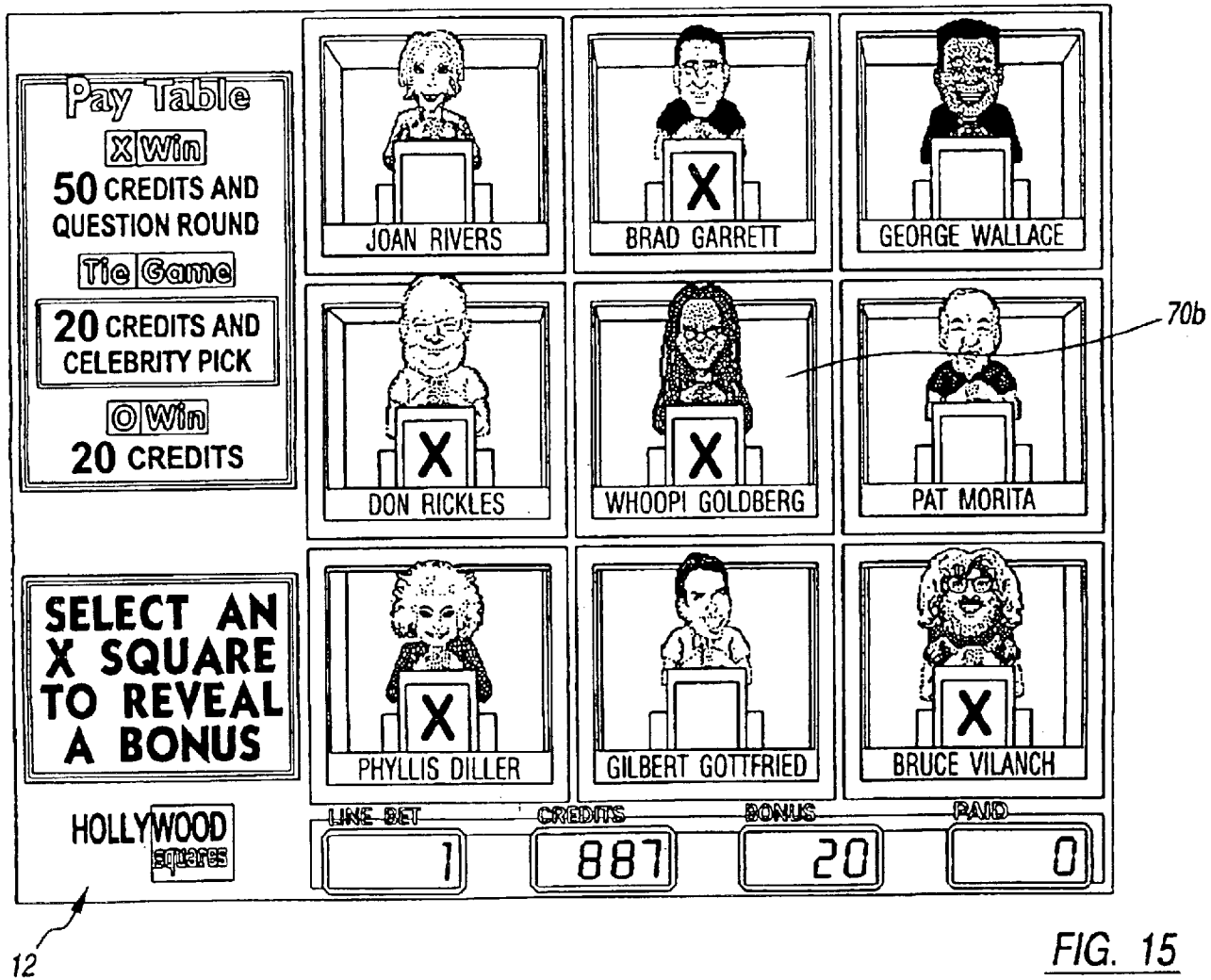
Figure 16:
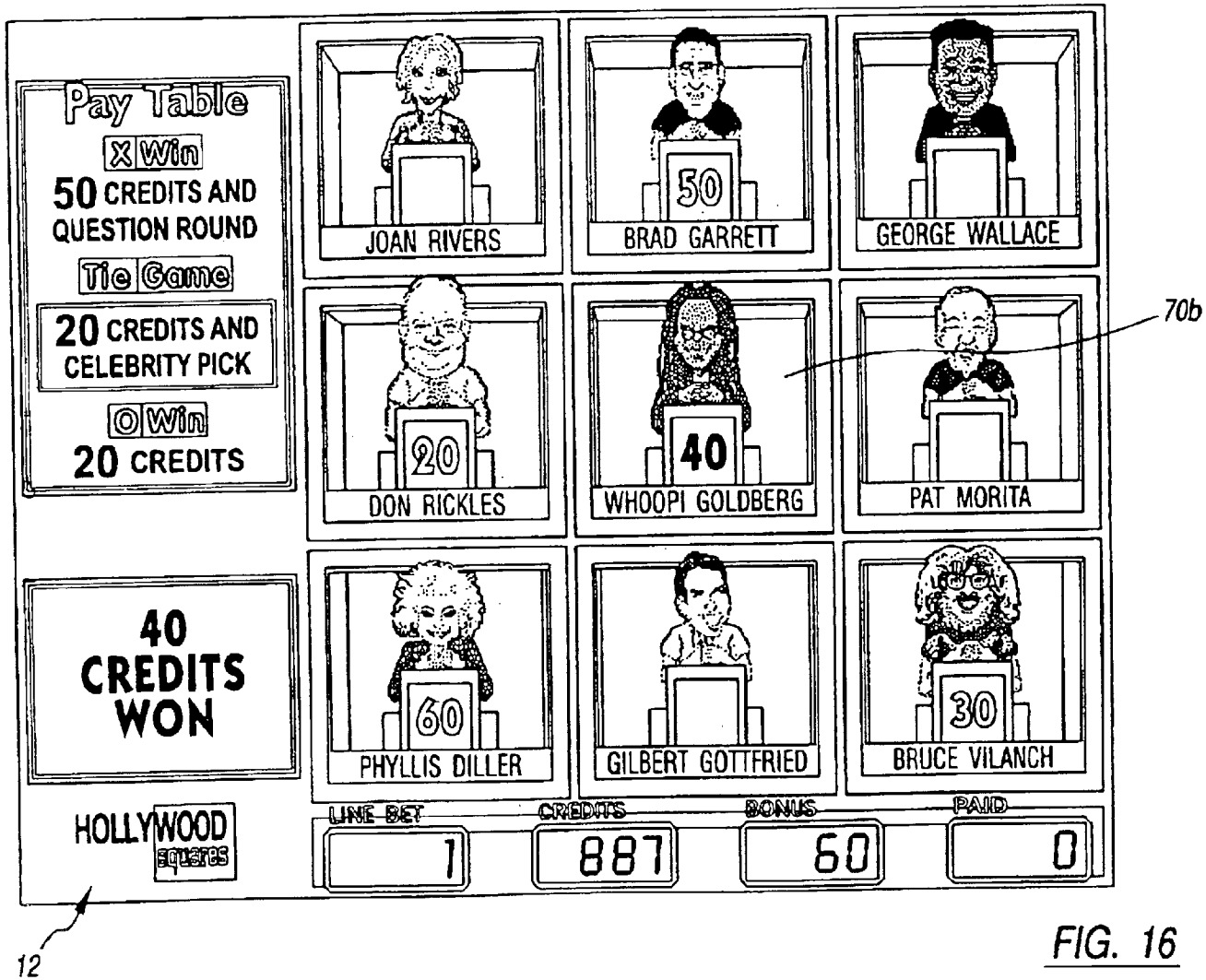

After the tic-tac-toe game is completed, the HOLLYWOOD SQUARES bonus game proceeds differently depending upon whether the tic-tac-toe game results in a win, a loss, or a stalemate/draw. First, if the tic-tac-toe game results in a win as shown in FIG. 10, the player is awarded a payout, such as a credit amount (e.g., 50 credits), and a Question Round. With respect to the Question Round shown in FIGS. 11 and 12, a humorous question (e.g., "In diner lingo—what is an Eve with a lid") is asked both audibly and printed on the display. The player is then prompted to select the celebrity (e.g., Pat Morita 70*a*) the player believes will answer the question correctly. The selected celebrity (e.g., Pat Morita 70*a*) then provides an answer (e.g., "A piece of apple pie") and a number of credits (e.g., 200 credits) is shown for that celebrity. The number of credits may be displayed before the question is asked. If the celebrity provides the correct answer as in the illustrated example, the player is awarded the number of credits multiplied by two or three. If the celebrity provides the incorrect answer, the player is awarded the number of credits. Second, if the tic-tac-toe game results in a loss as shown in FIG. 13, the player is awarded a consolation payout such as a modest credit amount (e.g., 20 credits). Third, if the tic-tac-toe game results in a stalemate/draw as shown in FIG. 14, the player is awarded a consolation payout, such as a modest credit amount (e.g., 20 credits), and a Celebrity Bonus. With respect to the Celebrity Bonus shown in FIGS. 15 and 16, the player is prompted to select any of the celebrities (e.g., Whoopi Goldberg 70*b*) associated with an "X". The player is awarded a payout such as a credit amount (e.g., 40 credits) for the selected "X" celebrity. Upon completion of the HOLLYWOOD SQUARES bonus game, the CPU shifts operation back to the basic slot game.

Figure 17:
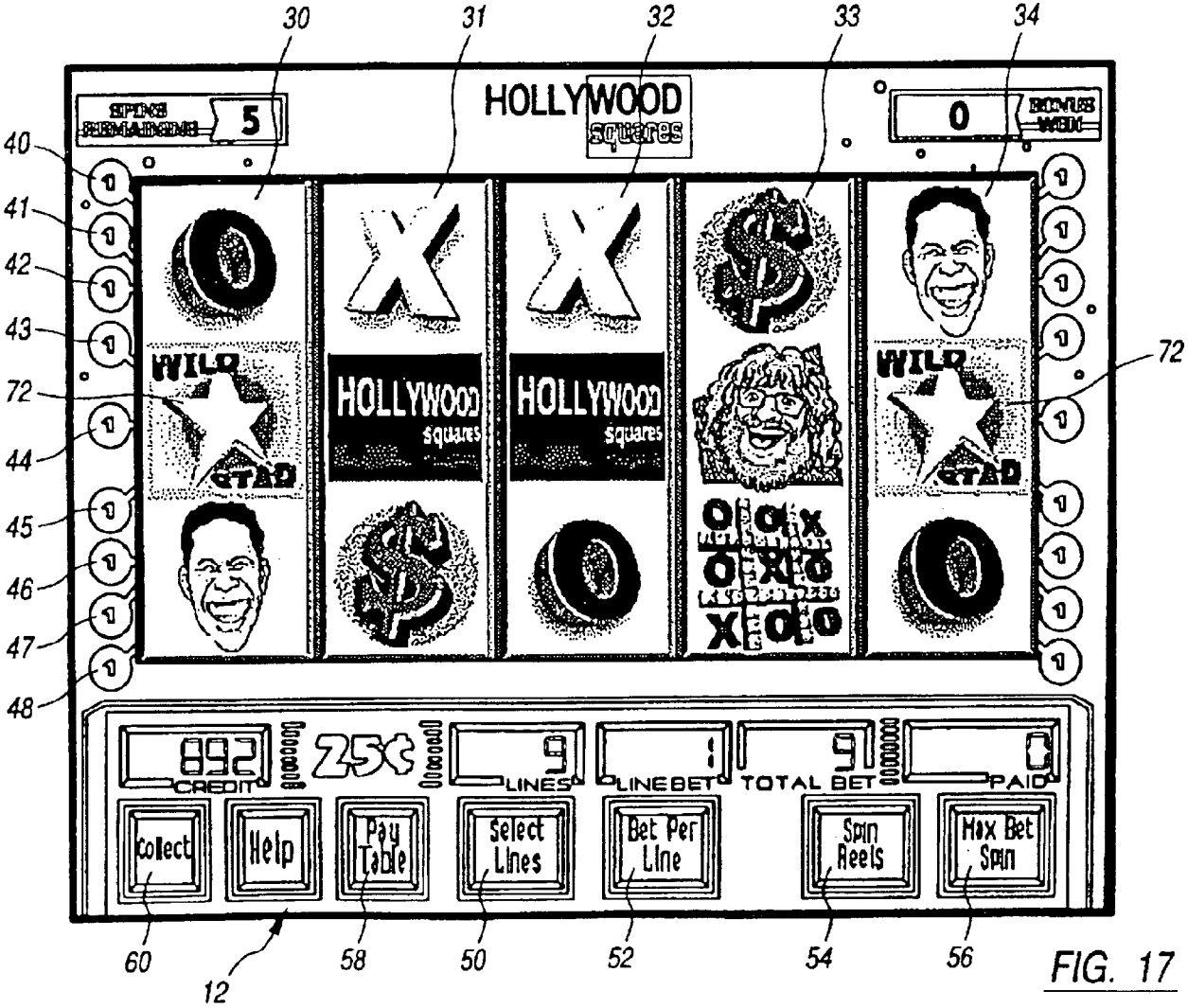
FIG. 17 is a display screen capture showing a second start-bonus outcome including STAR symbols on the first and last reels of the five-reel, nine-line basic game played on the gaming machine.
Figure 18:
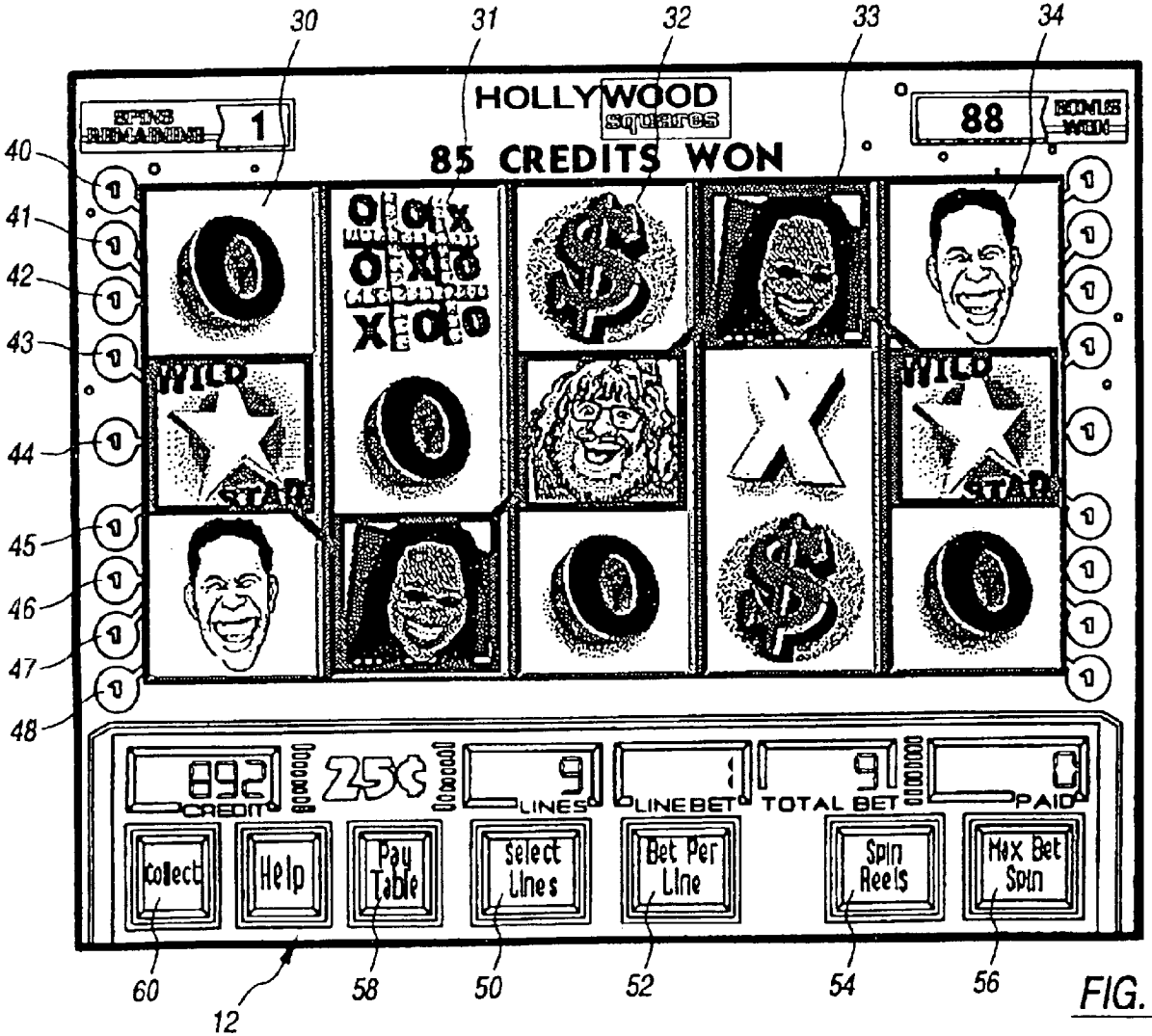
FIG. 18 is a display screen capture showing a winning symbol combination in a Free Spin Bonus game triggered by the second start-bonus outcome in FIG. 17.

Referring to FIG. 17, on the lower display 12, a Free Spin Bonus is triggered by a STAR symbol 72 on the first and fifth reels 30 and 34 in any position in the basic slot game. In the Free Spin Bonus, the STAR symbols animate into a "wild" STAR symbol that is wild for all symbols except the HOLLYWOOD SQUARES symbol. Also, the player is awarded a random or predetermined number of free spins of the second, third, and fourth reels 31, 32, and 33, while the first and fifth reels 30 and 34 containing the STAR symbols remain locked (do not spin). For example, the number of free spins may always be five or may be randomly selected to be in the range from five to ten. After each spin, as in the basic slot game the player is awarded a payout for any winning combinations along active pay lines. FIG. 18 illustrates such a winning combination along pay line 43 on the lower display 12. The amount of the payout is determined by the pay table employed in the basic slot game. Upon completion of the Free Spin Bonus, the CPU shifts operation back to the basic slot game.

Figure 19:
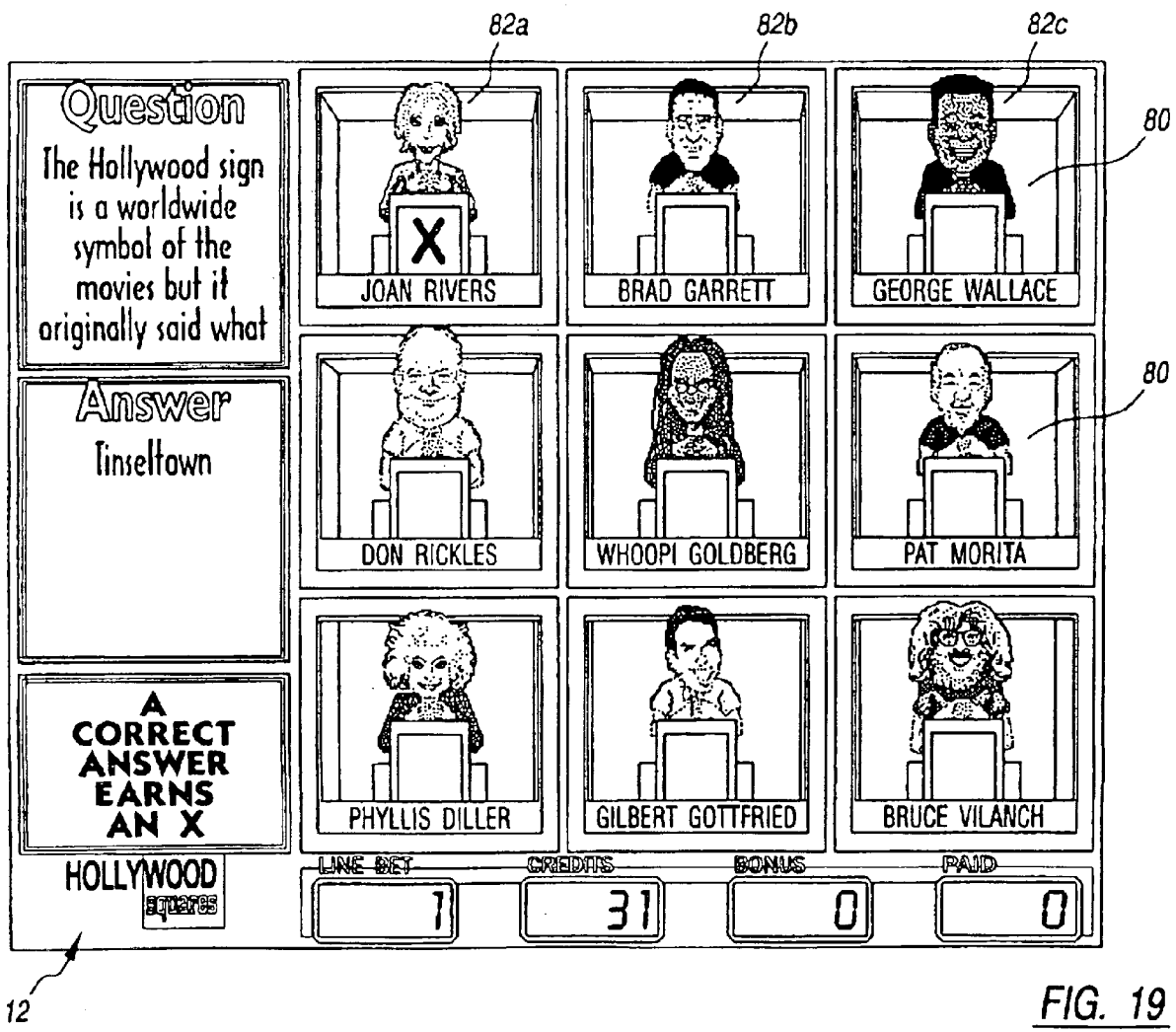
FIG. 19 is a display screen capture showing the Secret X game.

Referring to FIG. 19, a Secret "X" Bonus game on the lower display 12 may be triggered by another start-bonus outcome in the basic slot game. In the Secret "X" Bonus game, the display depicts a tic-tac-toe array of locations (squares) 80 individually selectable by a player. An animated celebrity is illustrated in each location 80. The tic-tac-toe array includes three columns 82*a*, 82*b*, and 82*c* with three locations 80 in each column. A secret "X" is associated with one of the three locations 80 in the second column 82*b*. The player is prompted to select one of the remaining six locations 80 in the first and third columns 82*a* and 82*c* for placement of a free "X":

| | | |
|---|---|---|
| X | | |
| | | |
| | | |

The player can earn up to two more "X's" in the first and third columns 82*a* and 82*c* by successively selecting celebrities that the player believes will correctly answer successive humorous questions asked both audibly and printed on the display. For example, believing that the secret "$X_s$" is in the top row of the second column 82*b*, the player may first select the celebrity in the top row of the third column 82*c* to correctly answer a first question (e.g., "The Hollywood sign is a worldwide symbol of the movies but it originally said what"). If the selected celebrity provides the incorrect answer (e.g., "Tinseltown") as illustrated, an "O" or nothing is placed in the location 80 of the selected celebrity. If, however, the selected celebrity had provided the correct answer, an "X" is placed in the location 80 of the selected celebrity:

| | | |
|---|---|---|
| X | | X |
| | | |
| | | |

The player may then select the celebrity in the bottom row of the third column 82*c* to correctly answer a second question. If the selected celebrity provides the incorrect answer, an "O" or nothing is placed in the location 80 of the selected celebrity. If, however, the selected celebrity provides the correct answer, an "X" is placed in the location 80 of the selected celebrity:

| | | |
|---|---|---|
| X | | X |
| | | |
| | | X |

After any earned "X's" are placed in the tic-tac-toe array, the secret "$X_s$" is revealed:

| | | |
|---|---|---|
| X | $X_s$ | X |
| | | |
| | | X |

If the secret "$X_s$" results in three "X's" along a row or a diagonal, the player is awarded a payout such as a credit amount. If, however, the secret "$X_s$" does not result in three "X's" along a row or a diagonal, the player may nonetheless be awarded a consolation payout.

In an alternative embodiment, the player is not limited to placing the free "X" and any earned "X's" in the first and third columns 82*a* and 82*c*. Rather, the player may place the free "X" and any earned "X's" in any of the nine locations 80 of the tic-tac-toe array. Therefore, if the player earns two "X's", the player would presumably place them along a row or a diagonal with the free "X" to guarantee three "X's" along a row or a diagonal without relying upon the secret "$X_s$" to provide the middle "X" in a tic-tac-toe. The payout for three "X's" along a row or a diagonal may be enhanced, such as multiplied by two, if the location 80 of one of the "X's" placed by the player coincides with the location of the secret "$X_s$".

Referring back to FIG. 1, in addition to or instead of the upper display 13 the gaming machine may be provided with a mechanical or back-lit glass array. The locations in the array correspond to the respective locations in the array depicted on the upper display 13. If the array is mechanical, each location in the array may be provided with a movable member, such as a rotatable cube, printed with the symbols "X", "O", and a blank. The movable member only displays one symbol at a time and initially displays a blank. As the bonus game is played, the movable member in each array location is moved, as necessary, to display the appropriate symbol. If the array is glass and back-lit, each location in the array may be printed with an "X" and an "O". Initially, neither the "X" nor the "O" is illuminated. As the game is played, the appropriate symbol is illuminated from behind the glass.

While the present invention has been described with reference to one or more particular embodiments, those skilled in the art will recognize that many changes may be made thereto without departing from the spirit and scope of the present invention.

For example, the basic game need not comprise a spinning reel slot machine game as illustrated in FIG. 1, but may comprise virtually any type of game of chance or skill or combination of games having outcomes (e.g., start-bonus outcomes) that trigger play of a bonus game on one or more displays. For example, the basic game may comprise a video poker or blackjack game. Also, the HOLLYWOOD SQUARES bonus game may be implemented as a stand-alone basic game that is not triggered by a start-bonus outcome on spinning reels.

Furthermore, the symbols, winning patterns, and size of the array may be varied. The number of symbol types may be modified to include more than two symbol types and to have configurations other than the traditional types "X" and "O". The winning pattern need not be limited to straight lines and need not be limited to including the same symbol type. For example, the symbol types could be "X", "Y", and "Z", and the winning pattern could require one of each symbol type.

Each of these embodiments and obvious variations thereof is contemplated as falling within the spirit and scope of the claimed invention, which is set forth in the following claims.

What is claimed is:

1. A method of conducting a game of chance on a gaming machine controlled by a processor, the method comprising:

receiving a wager;

displaying an array of locations individually selectable by a player and the processor;

receiving alternating selections by the player and the processor of unoccupied ones of the locations in the array for placement of respective first and second symbol types, the receiving selections by the processor includes: (a) determining, via the processor, a best location of unoccupied ones in the array for placing the second symbol type, (b) applying a predetermined weighted probability to determine whether the second symbol type should be placed in the best location of the unoccupied ones, (c) if, after applying the weighted probability, multiple unoccupied ones of the locations are available to receive the second symbol type, applying, via the processor, a random determination as to which of the multiple unoccupied ones of locations to place the second symbol type, the weighted probability varying with successive ones of the selections by the processor; and awarding a payout based on an outcome of the game.

2. The method of claim 1, wherein the weighted probability increases the probability of a winning outcome for the processor with successive ones of the selections by the processor.

3. The method of claim 2, wherein the weighted probability increases the probability of a winning outcome by about 10 percent with each successive selection by the processor.

4. The method of claim 1, wherein displaying the array of locations includes displaying the array of locations on a video display.

5. The method of claim 1, wherein awarding a payout includes awarding a first payout for a win by the player, a second payout for a win by the processor, and a third payout for a draw.

6. A game of chance for a gaming machine controlled by a processor in response to a wager, the game comprising:

an array of locations individually selectable by a player and the processor;

means for receiving alternating selections by the player and the processor of unoccupied ones of the locations in the array for placement of respective first and second symbol types, the receiving selections by the processor includes: (a) determining, via the processor, a best location of unoccupied ones in the array for placing the second symbol type, (b) applying a predetermined weighted probability to determine whether the second symbol type should be placed in the best location of the unoccupied ones, (c) if, after applying the weighted probability, multiple unoccupied ones of the locations are available to receive the second symbol type, applying, via the processor, a random determination as to which of the multiple unoccupied ones of locations to place the second symbol type, the weighted probability varying with successive ones of the selections by the processor; and, means for awarding a payout based on an outcome of the game.

7. The game of claim 6, wherein the weighted probability increases the probability of a winning outcome by the processor increases with successive ones of the selections by the processor.

8. The game of claim 7, wherein the weighted probability increases the probability of a winning outcome by the processor increases by about 10 percent with each successive selection by the processor.

9. The game of claim 6, wherein the array of locations is displayed on a video display.

10. The game of claim 6, wherein the means for awarding a payout includes means for awarding a first payout for a win by the player, a second payout for a win by the processor, and a third payout for a draw.

* * * * *